US010569407B2

(12) United States Patent
Meixner et al.

(10) Patent No.: US 10,569,407 B2
(45) **Date of Patent: *Feb. 25, 2020**

(54) HANDHELD POWER TOOL, FANLESS POWER SUPPLY UNIT AND TOOL SYSTEM

(71) Applicant: Hilti Aktiengesellschaft, Schaan (LI)

(72) Inventors: Ralf Meixner, Germaringen (DE); Holger Cecchin, Puchheim (DE); Bernd Ziegler, Hiltenfingen (DE)

(73) Assignee: Hilti Aktiengesellschaft, Schaan (LI)

( * ) Notice: Subject to any disclaimer, the term of this patent is extended or adjusted under 35 U.S.C. 154(b) by 293 days.

This patent is subject to a terminal disclaimer.

(21) Appl. No.: 15/531,977

(22) PCT Filed: Nov. 30, 2015

(86) PCT No.: PCT/EP2015/078015

§ 371 (c)(1),
(2) Date: May 31, 2017

(87) PCT Pub. No.: WO2016/087344

PCT Pub. Date: Jun. 9, 2016

(65) Prior Publication Data

US 2017/0334055 A1 Nov. 23, 2017

(30) Foreign Application Priority Data

Dec. 1, 2014 (EP) ..... 14195557

(51) Int. Cl.
*B25F 5/00* (2006.01)
*B25D 16/00* (2006.01)
*B25D 17/20* (2006.01)

(52) U.S. Cl.
CPC ..... *B25F 5/008* (2013.01); *B25D 16/00* (2013.01); *B25D 17/20* (2013.01); *B25D 2217/0061* (2013.01)

(58) Field of Classification Search
CPC . B25F 5/008; H01M 10/486; H01M 10/6563; H01M 10/6235; H01M 2220/30;
(Continued)

(56) References Cited

U.S. PATENT DOCUMENTS 8,418,780 B2 * 4/2013 Lau ..... B25F 5/008 173/171
9,132,542 B2 9/2015 Lau et al.
(Continued)

FOREIGN PATENT DOCUMENTS

CN 101456181 A 6/2009
CN 101543967 A 9/2009
(Continued)

OTHER PUBLICATIONS

PCT/EP2015/078015, International Search Report (PCT/ISA/210 and PCT/ISA/220) dated Jan. 27, 2016, with partial English Translation, enclosing Written Opinion of the International Searching Authority (PCT/ISA/237) (Seventeen (17) pages).
(Continued)

*Primary Examiner* — Nathaniel C Chukwurah
(74) *Attorney, Agent, or Firm* — Crowell & Moring LLP

(57) ABSTRACT

A hand-held power tool, in particular a hammer drill or combination hammer, is disclosed. The power tool includes a tool housing which has a receiving recess designed to replaceably receive a storage battery or a power supply unit. The hand-held power tool further includes an electric drive motor having a cooling fan and a first vent portion which is located on the tool housing outside the receiving recess and through which a volume flow generated by the cooling fan can be guided. The tool housing has a second vent portion which is different from the first vent portion and which is located in the receiving recess and through which the volume flow generated by the cooling fan can be at least partially guided.

9 Claims, 8 Drawing Sheets

(58) Field of Classification Search
CPC ..... B25D 17/20; B25D 16/00; B25D 11/00; B25D 2217/0061
USPC ..... 173/217, 48, 109, 201
See application file for complete search history.

(56) References Cited

U.S. PATENT DOCUMENTS

| | | | | |
|---|---|---|---|---|
| 2005/0202310 | A1 | 9/2005 | Yahnker et al. | |
| 2008/0057382 | A1* | 3/2008 | Kimura | H01M 2/1016 429/120 |
| 2011/0303718 | A1* | 12/2011 | Spasov | B25C 1/06 227/2 |

FOREIGN PATENT DOCUMENTS

| | | | |
|---|---|---|---|
| CN | 102284947 | A | 12/2011 |
| DE | 10 2007 039 828 | B3 | 11/2008 |
| DE | 10 2008 060 703 | A1 | 6/2009 |
| DE | 10 2009 015 422 | A1 | 10/2009 |
| EP | 0 940 864 | A2 | 9/1999 |

OTHER PUBLICATIONS

U.S. Patent Application, "Hand-Held Power Tool, Fanless Storage Battery", filed May 31, 2017, Inventor Ralf Meixner et al.
Partial English machine translation of previously submitted B1 (Four (4) pages).

* cited by examiner

HANDHELD POWER TOOL, FANLESS POWER SUPPLY UNIT AND TOOL SYSTEM

This application claims the priority of International Application No. PCT/EP2015/078015, filed Nov. 30, 2015, and European Patent Document No. 14195557.5, filed Dec. 1, 2014, the disclosures of which are expressly incorporated by reference herein.

BACKGROUND AND SUMMARY OF THE INVENTION

The present invention relates to a handheld power tool, particularly a hammer drill or combination hammer. The handheld power tool has a tool housing, which has a receiving recess designed for replaceably receiving a storage battery or a power supply unit. The handheld power tool also has an electric drive motor with a cooling fan and a first vent section arranged on the tool housing outside of the receiving recess. A volume flow generated by the cooling fan of the handheld power tool can be guided through the first vent section. In this way, the electric drive motor of the handheld power tool, which generates heat when operating, can be cooled.

Handheld power tools, particularly a hammer drill or combination hammer, can be supplied with electrical energy either by a storage battery or a power supply unit, when these are connected to the handheld power tool. To this end, the power supply unit has a power cable, which establishes a connection to a mains power supply source (also referred to as a power outlet).

The present invention also relates to a fanless power supply unit for a handheld power tool, wherein the fanless power supply unit is designed for the replaceable accommodation within a receiving recess of a handheld power tool.

Furthermore, the present invention relates to a tool system having a handheld power tool and a fanless power supply unit.

It is the object of the present invention to provide a handheld power tool, a power supply unit, as well as a tool system with improved cooling capacity.

In regard to the handheld power tool, the task is solved by the tool housing having a second vent section that differs from the first vent section, the second section being arranged within the receiving recess and through which the volume flow generated by the cooling fan can at least be partially guided.

Advantageously, a volume flow generated by the cooling fan of the handheld power tool can now be guided at least partially through the second vent section into the receiving section and be used there for cooling tasks.

In a preferred design, the second vent section is provided in such a manner that a storage battery with a closed surface (tool storage battery of the prior art) held in the receiving recess seals the second vent section. In this way, a closed-surface storage battery held in the receiving recess can be forced-cooled (by a volume flow generated by the cooling fan and flowing through the first vent and past the storage battery via the second vent section).

Preferably, the first and/or second vent section is/are open toward ambient air when the receiving recess is empty. In a particularly preferred manner, the receiving recess is designed for the tool-free replaceable receiving of a storage battery or power supply unit.

It has proven itself to be advantageous when the first vent section is arranged on the housing in such a manner that a volume flow portion generated by the ventilation fan and passing through the first vent section flows axially to a ventilation axis of the ventilation fan. Preferably, the second vent section is arranged on the housing in such a manner that a volume flow portion generated by the ventilation fan and flowing through the second vent section flows transversely to the ventilation axis of the cooling fan.

In a particularly advantageous enhancement, the handheld power tool has a flow control means that is designed to distribute, as a function of the storage battery or power supply unit held in the receiving recess, a volume flow generated by the cooling fan between the first and second ventilation sections. A higher volume flow portion through the first vent section can be assigned to storage battery operating mode and higher volume flow portion through the second vent section can be assigned to power supply unit operating mode of the handheld power tool.

Preferably, the flow control means is designed as an externally operated change-over gate. In a first switch position, the externally operated change-over gate can close off the first vent section. Preferably, in a second switch position, the flow control means designed as an externally operated change-over gate can close off the second vent section.

It has proven itself to be advantageous if the first vent section and the second vent section belong to vents that differ from each other. Alternatively, the first vent section and the second vent section can belong to the same vent. Preferably, the first vent section and the second vent section are arranged essentially perpendicular to each other.

In regard to the fanless power supply unit, the present task is solved in that the fanless power supply unit has an inner ventilation channel open to the environment. Via this ventilation channel, the fanless power supply unit, when it is held in a receiving recess, of a handheld power tool, designed for the replaceable accommodation of the power supply unit, can be forced-cooled by means of a volume flow generated by the ventilation fan of the handheld power tool.

Preferably, the inner ventilation channel runs between a front vent and a rear vent of the power supply unit. These can be arranged on opposite end faces of the power supply unit. In a particularly preferred manner, the front vent is arranged on the power supply unit in such a manner that when the power supply unit is held in the receiving recess, the front vent is essentially congruent with the second vent section.

The invention includes the knowledge that a volume flow generated by a cooling fan of a handheld power tool, particularly in the form of aspirated cooling air, can be used for cooling a power supply unit designed for the replaceable accommodation in a receiving recess having an inner ventilation channel open to the environment according to the invention. In this way, one can forego an additional cooling fan in the power supply unit, by means of which one can construct a power supply unit in a particularly compact and cost-effective manner. This also has the advantage that a power supply unit having the same external dimensions can be designed to be significantly more powerful.

In a particularly preferred enhancement, the fanless power supply unit has a closing element, which is designed to effect an at least partial closing of a first vent section arranged outside of the receiving recess of the handheld power tool, when the fanless power supply unit is held in the receiving recess. In this way, a larger portion of the volume flow generated by the ventilation fan can be directed through the second vent section and thereby be used for cooling.

The closing element may be designed as a projecting sealing plate, which covers the first vent section of the handheld power tool. In this way, a particularly simple and robust closing element can be provided. The closing element designed as a projecting sealing plate may have a rubber seal, which is arranged in such a manner that it surrounds and/or seals the first vent section when the fanless power supply unit is held in the receiving recess.

The closing element can be a sliding element, which is designed to switch over an externally operated change-over gate provided in the handheld power tool from a second switch position to a first one. Preferably, one can thereby open a second vent section arranged inside the receiving recess of the handheld power tool toward the inner ventilation channel of the fanless power supply unit so that the fanless power supply unit is forced-cooled via the second vent section. The closing element can be designed as a sliding rod or a sliding bar for example. Preferably, the sliding element is arranged on the power supply unit and designed in such a manner that it engages in the housing of the handheld power tool when the fanless power supply unit is held in the receiving recess. The tailless power supply unit can be designed for the tool-free replaceable accommodation in a receiving recess of a handheld power tool.

In regard to the tool system, the present task is solved by a tool system, which has a handheld power tool described above and a fanless power supply unit described above. Preferably, the tool system also has a storage battery, which is designed for the replaceable accommodation in a receiving recess of a handheld power tool.

Other advantages emerge from the following description of the drawings. The drawings depict various embodiments of the present invention. The drawings, the description, and the claims contain numerous features in combination. A person skilled in the art will appropriately consider the features individually and bring them together into other reasonable combinations.

In the drawings, identical and similar components are labeled with the same reference sign.

DETAILED DESCRIPTION OF THE DRAWINGS

Figure 1:
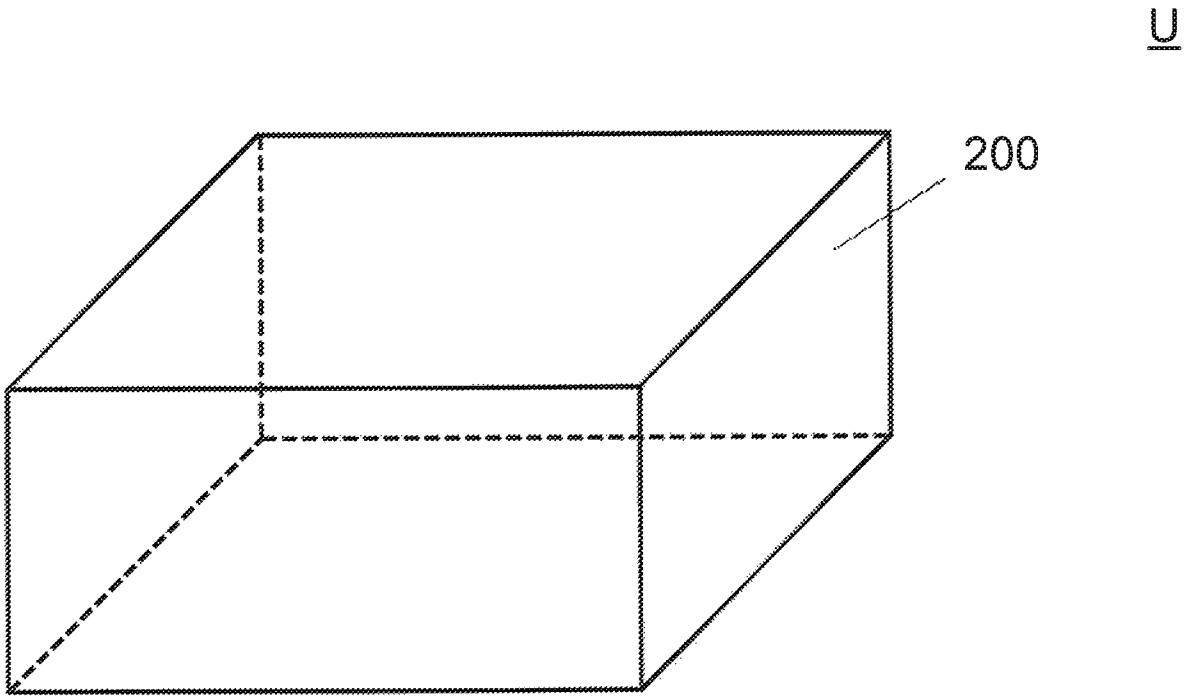
Fig. 1 PRIOR ART
FIG. 1 is a schematic diagram of a storage battery according to prior art.

FIG. 1 depicts a storage battery 200 according to the prior art, which has a closed surface. Storage battery 200 is designed for the tool-free replaceable accommodation in a non-depicted receiving recess, wherein a depiction of the attachment means was intentionally omitted here.

Figure 2:
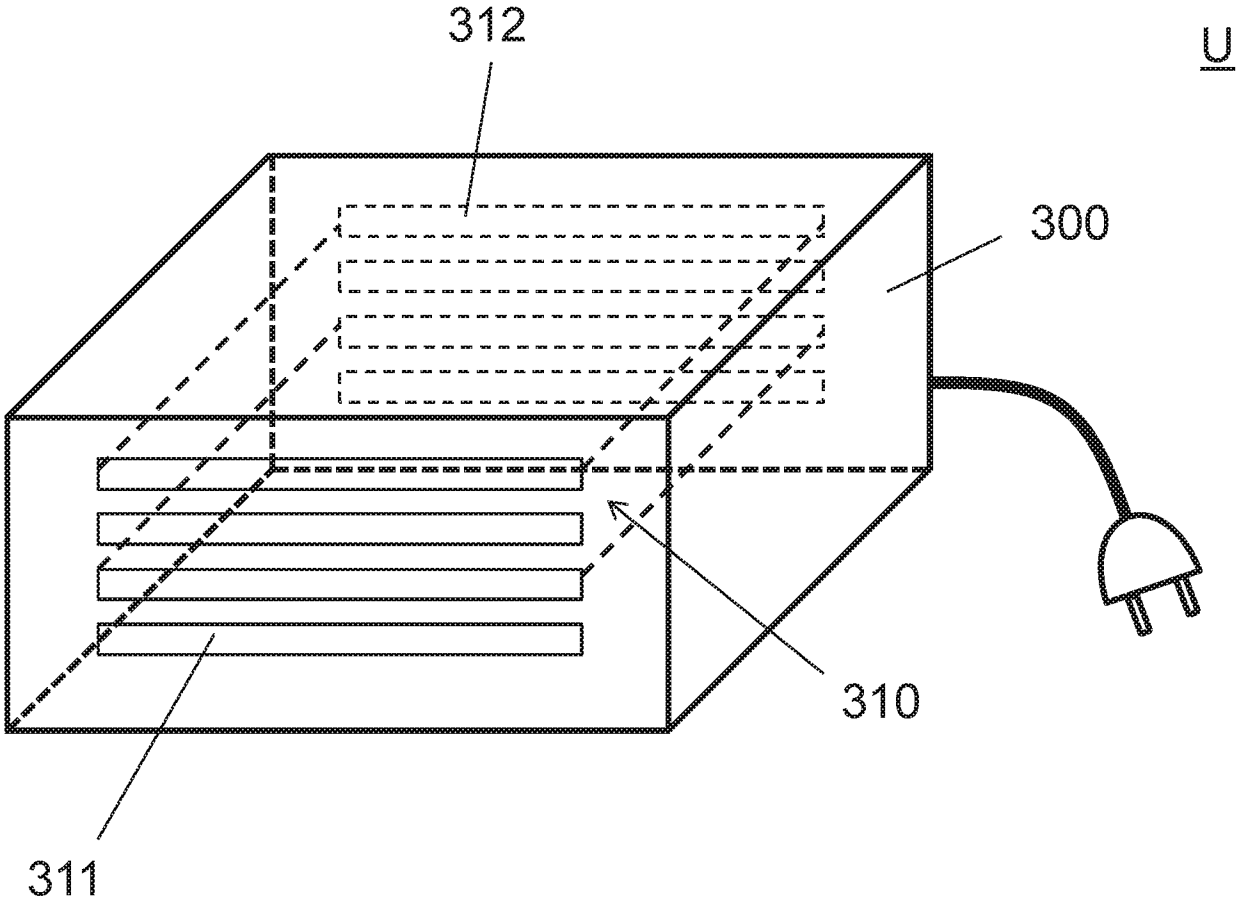
FIG. 2 is a schematic diagram of a power supply unit according to the invention.

A fanless power supply unit 300 is shown in perspective in FIG. 2 and has an inner ventilation channel 310, by means of which fanless power supply unit 300 can be forced-cooled. As one can see in FIG. 2, inner ventilation channel 310 runs between a front vent 311 and a rear vent 312, which are arranged on opposite end faces of power supply unit 300. When fanless power supply unit 300 is used as intended, a volume flow aspirated via a non-depicted cooling fan can flow through rear vent 312 into inner ventilation channel 310 to be guided out of fanless power supply unit 300 out of front vent 311, which is arranged on the front side of fanless power supply unit 300 and intended to be in contact with a second vent section of a non-depicted handheld power tool.

Figure 3:
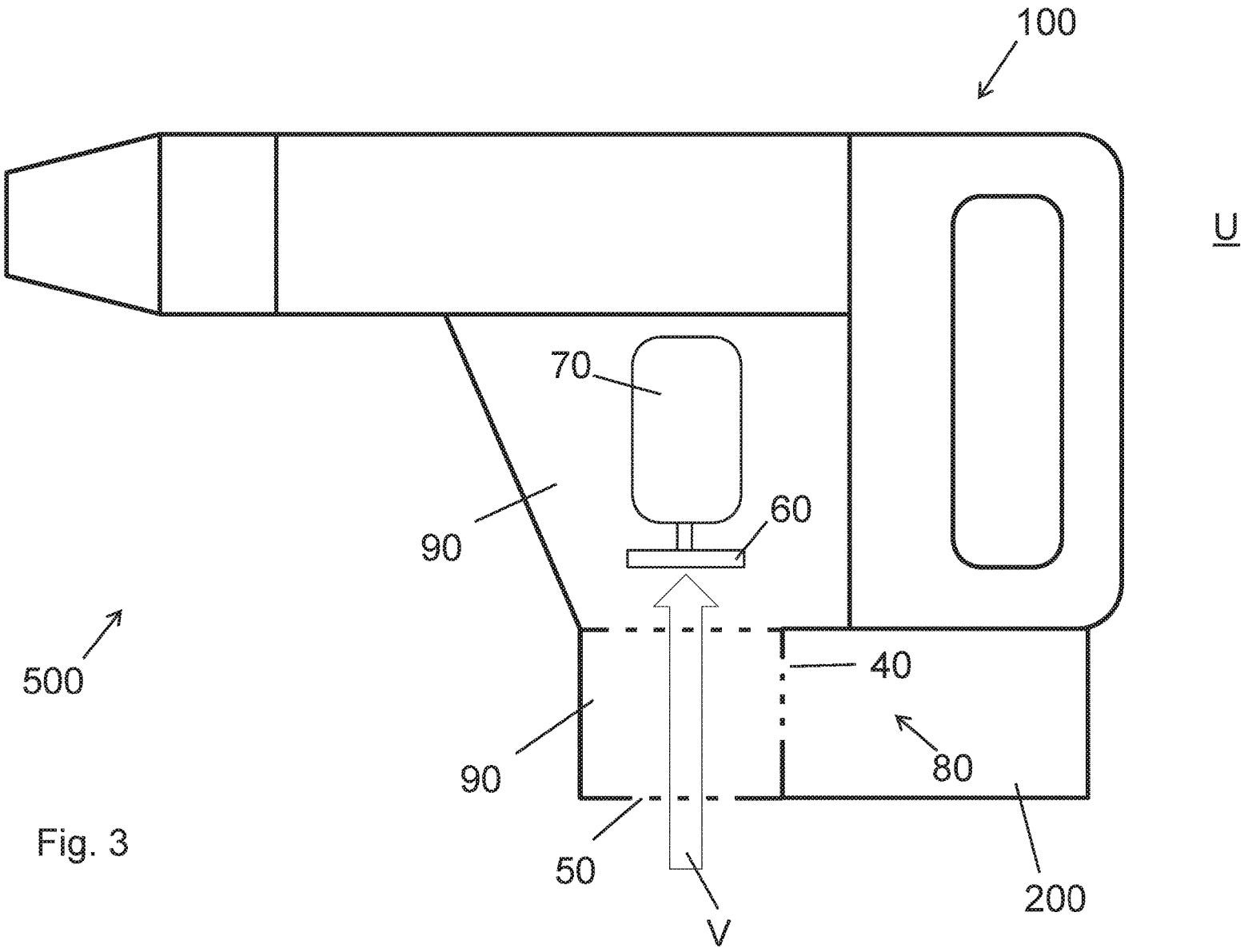
FIG. 3 is a schematic diagram of a tool system according to the invention with a handheld power tool and a storage battery.

A tool system 500 in FIG. 3 has a handheld power tool 100, in this case a hammer drill. Handheld power tool 100 has a tool housing 90, which has a receiving recess 80 designed for the replaceable holding of a storage battery 200. As one can see in FIG. 3, handheld power tool 100 has an electric drive motor 70 with a cooling fan 60. On tool housing 90, there is arranged outside of receiving recess 80 a first vent section 50. A second vent section 40 is arranged on tool housing 90 in such a manner that closed-surface storage battery 200 held in receiving recess 80 seals second vent section 40. In this case, first vent section 50 and second vent section 40 belong to different vents, which are arranged perpendicular to each other on tool housing 90.

Volume flow V aspirated through cooling fan 60 now flows only through first vent section 50, since second vent section 40 is sealed by replaceable closed-surface storage battery 200 held in receiving recess 80. Advantageously, sealed second vent section 40 already results in forced cooling of storage battery 200 by means of portions of volume flow V, which flow along second vent section 40 past storage battery 200, but do not flow through storage battery 200.

Figure 4:
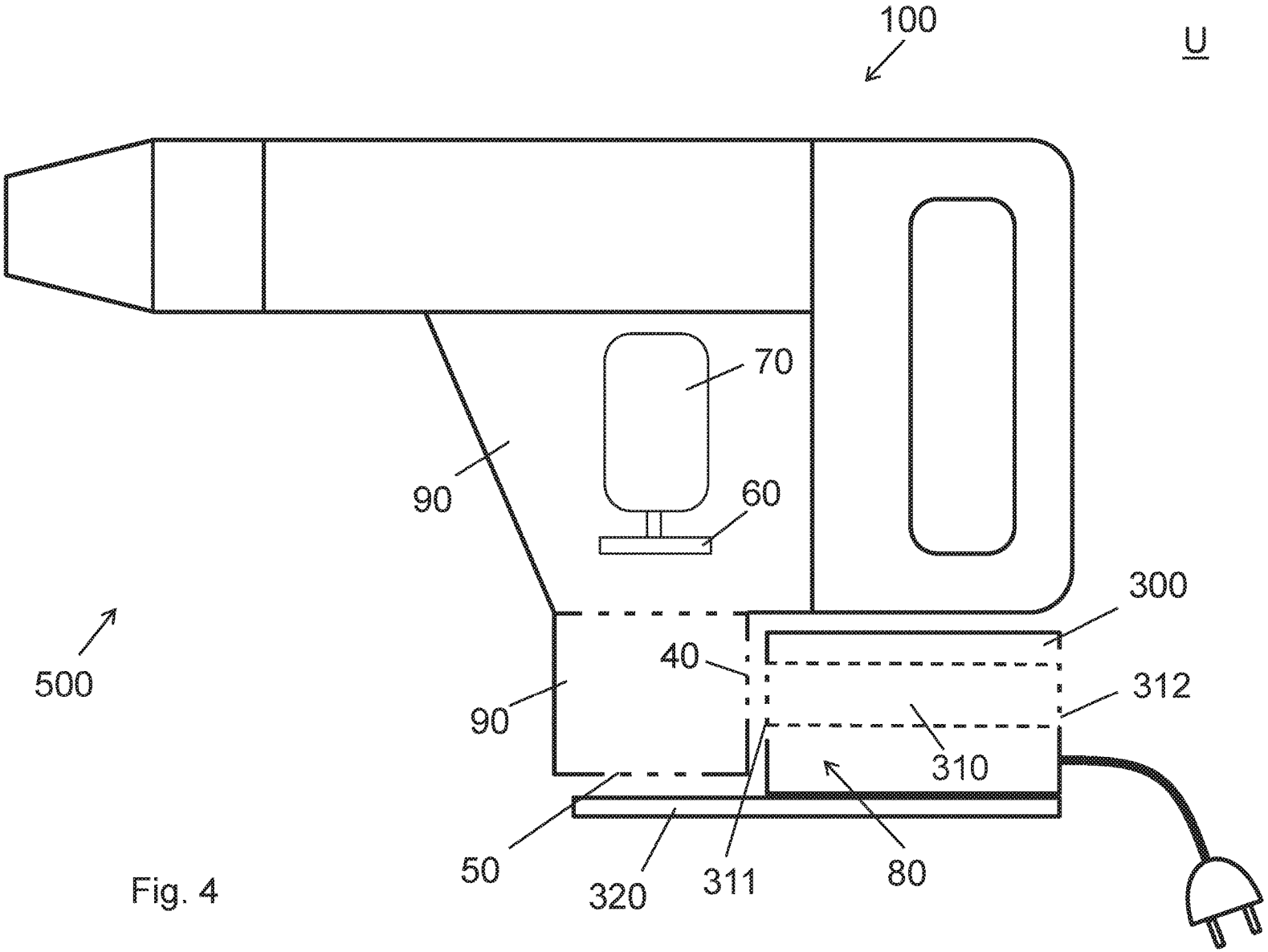
FIG. 4 is a schematic diagram of another embodiment of a tool system according to the invention.

In FIG. 4, a tool system 500 according to the invention has a handheld power tool 100, which corresponds to handheld power tool 100 described in reference to FIG. 3.

FIG. 4 depicts a fanless power supply unit 300 according to the invention, which is already located in the proximity of a receiving recess 80, yet is not completely held in the recess. Fanless power supply unit 300 of FIG. 4 has a sealing element designed as a projecting sealing plate 320, which is intended to cover first vent section 50 of machine tool 100. As one can see in FIG. 4, inner ventilation channel 310 runs between front vent 311 and rear vent 312 of fanless power supply unit 300. As one can also see in FIG. 4, front vent opening 311 of power supply unit 300 is arranged on power supply unit 300 in such a manner that when power supply unit 300 is held in receiving recess 80, front vent 311 is congruent with second vent section 40.

Figure 5:
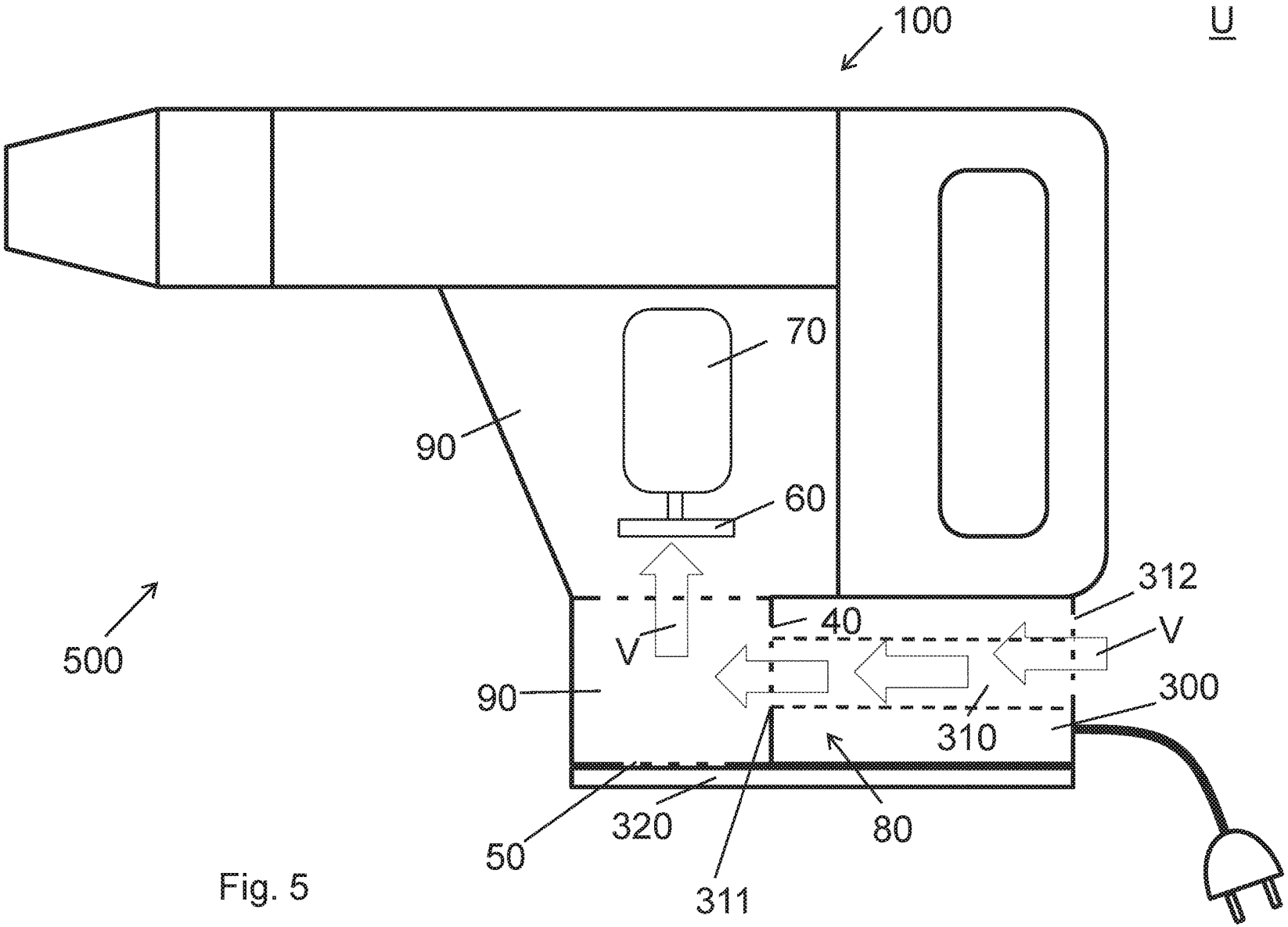
FIG. 5 is another schematic diagram of the tool system according to the invention from FIG. 4.

FIG. 5 depicts tool system 500 from FIG. 4, wherein fanless power supply unit 300 is now completely held in receiving recess 80. The sealing element, designed as a projecting sealing plate 320, of fanless power supply unit 300, now completely covers first vent section 50 of tool housing 90 so that a volume flow V, which is generated by cooling vent 60 driven by means of electric drive motor 70, cannot pass through the first vent section. Instead, volume flow V flows entirely through second vent section 40, wherein aspiration via rear vent 312 of power supply unit 300 occurs.

As indicated in FIG. 5 by arrows in the region of power supply unit 300, the aspirated volume flow flows through inner ventilation channel 310 of power supply unit 300 to cool the latter. Subsequently, volume flow V flows through second vent section 40 into tool housing 90 of the handheld power tool to also be simultaneously used for cooling electric drive motor 70. The subsequent course of volume flow V is not further depicted for the sake of simplicity.

Typically, there is provided on tool housing 90 in the upper region of the chuck an additional vent through which volume flow V can escape from the housing.

Figure 6:
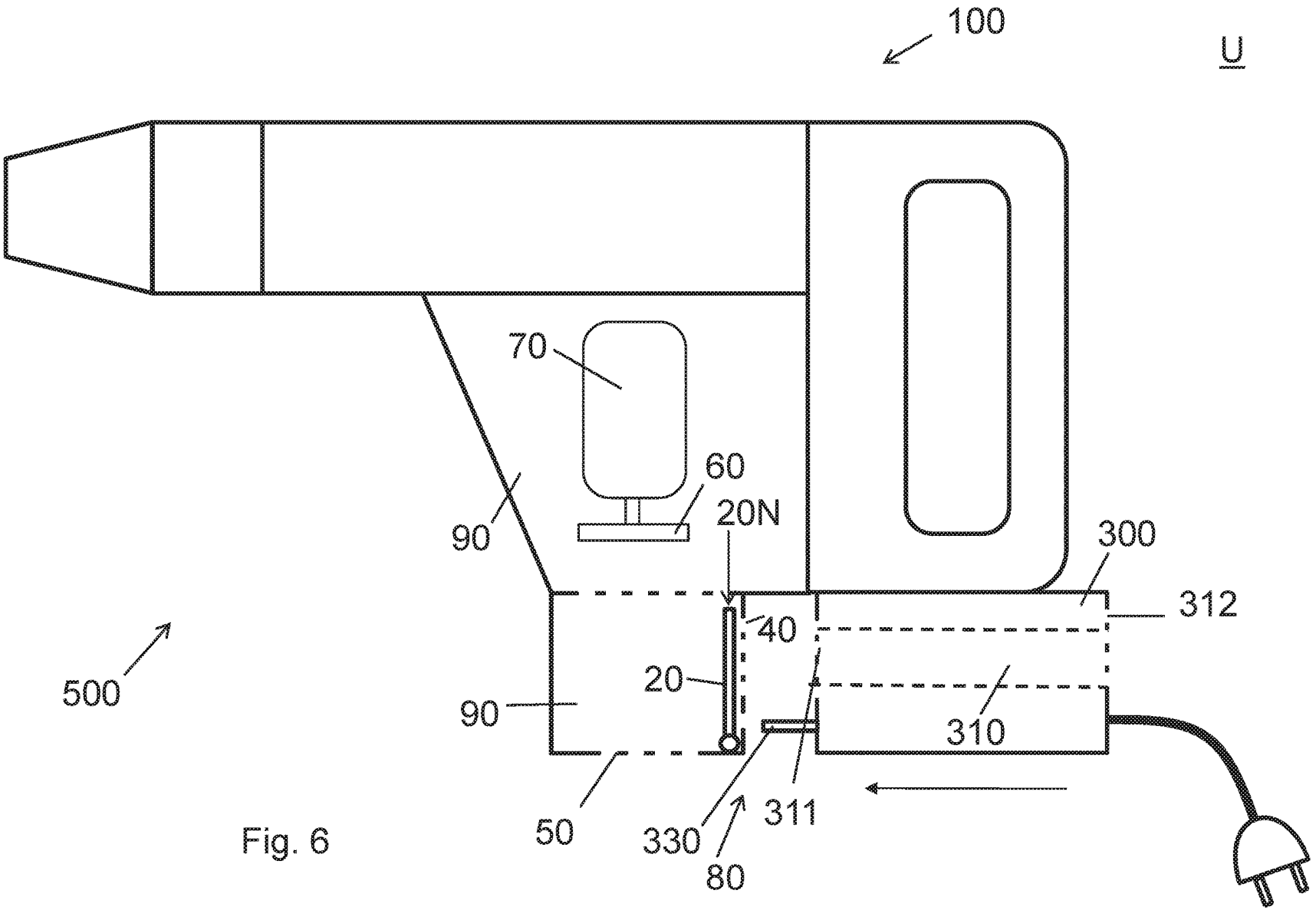
FIG. 6 is a schematic diagram of another preferred embodiment of a tool system according to the invention.

FIG. 6 depicts another embodiment of a tool system 500 according to the invention. Handheld power tool 100 has a flow control means designed as an externally operated change-over gate 20. The flow control means designed as an externally operated change-over gate 20 is designed to distribute, as a function of power supply unit 300 being held in receiving recess 80, a volume flow V generated by cooling fan 60 between first vent section 50 and second vent section 40. In second switch position 20N of externally operated change-over gate 20, second vent section 40 is essentially fully closed.

As one can also see in FIG. 6, fanless power supply unit 300 has a sealing element designed in this case as a sliding element 330, which is designed to effect a sealing of first vent section 50 arranged outside of receiving recess 80 of handheld power tool 100, when fanless power supply unit 300 is held in receiving recess 80. Since fanless power supply unit 300 in FIG. 6 is not held in receiving recess 80, first vent section 50 is not sealed. Sliding element 330 of fanless power supply unit 300 is designed to engage in tool housing 90 through second vent section 40 when fanless power supply unit 300 is inserted into receiving recess 80 and to thereby move externally operated change-over gate 20 out of its depicted second switch position 20N.

Figure 7:
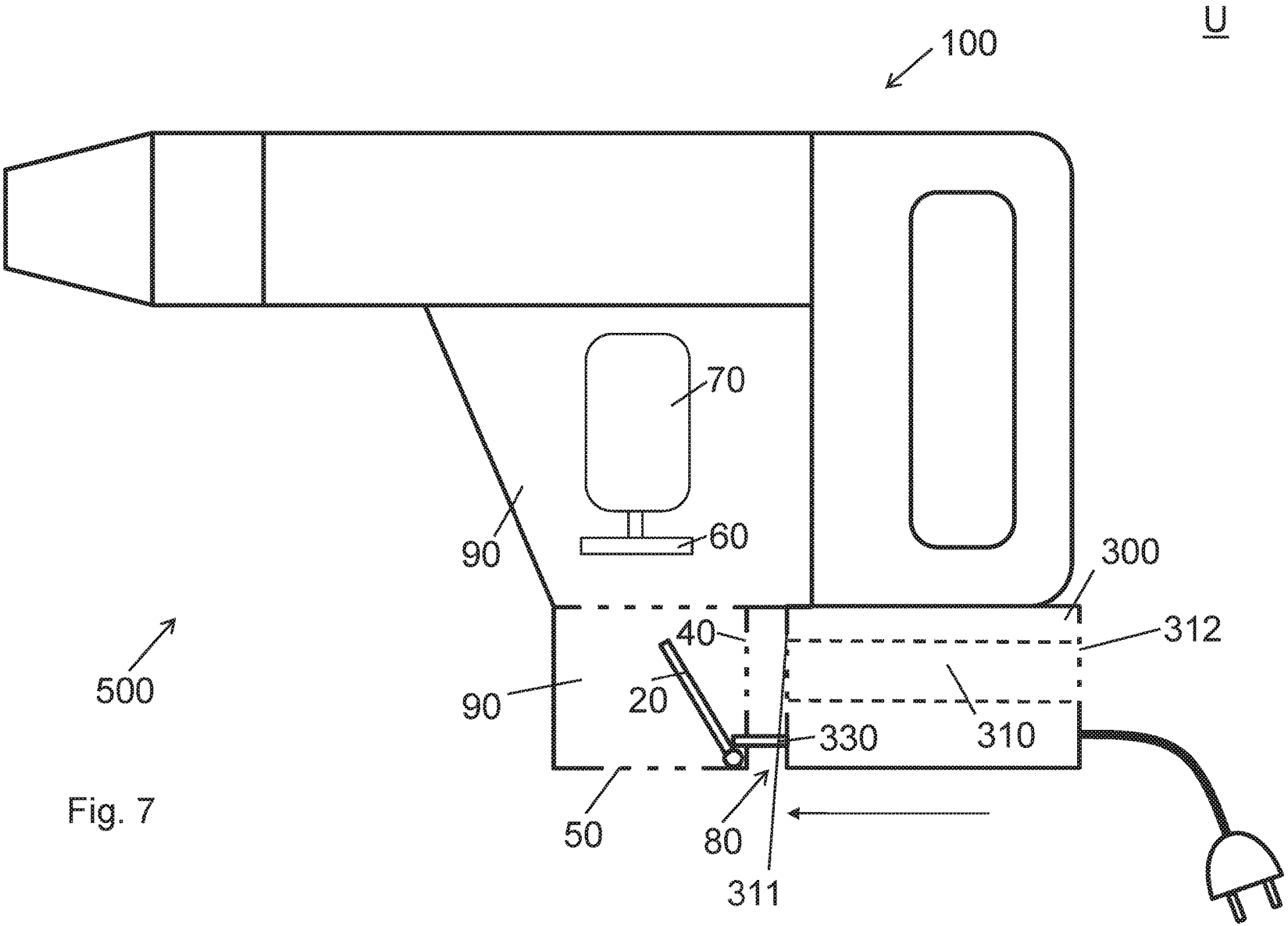
FIG. 7 is another schematic diagram of the tool system from FIG. 6.

FIG. 7 now shows how sliding element 330 acts on externally operated change-over gate 20. By moving further along in the direction of the arrow, externally operated change-over gate 20 is slid toward first vent section 50 to ultimately seal it, as depicted in FIG. 8.

Figure 8:
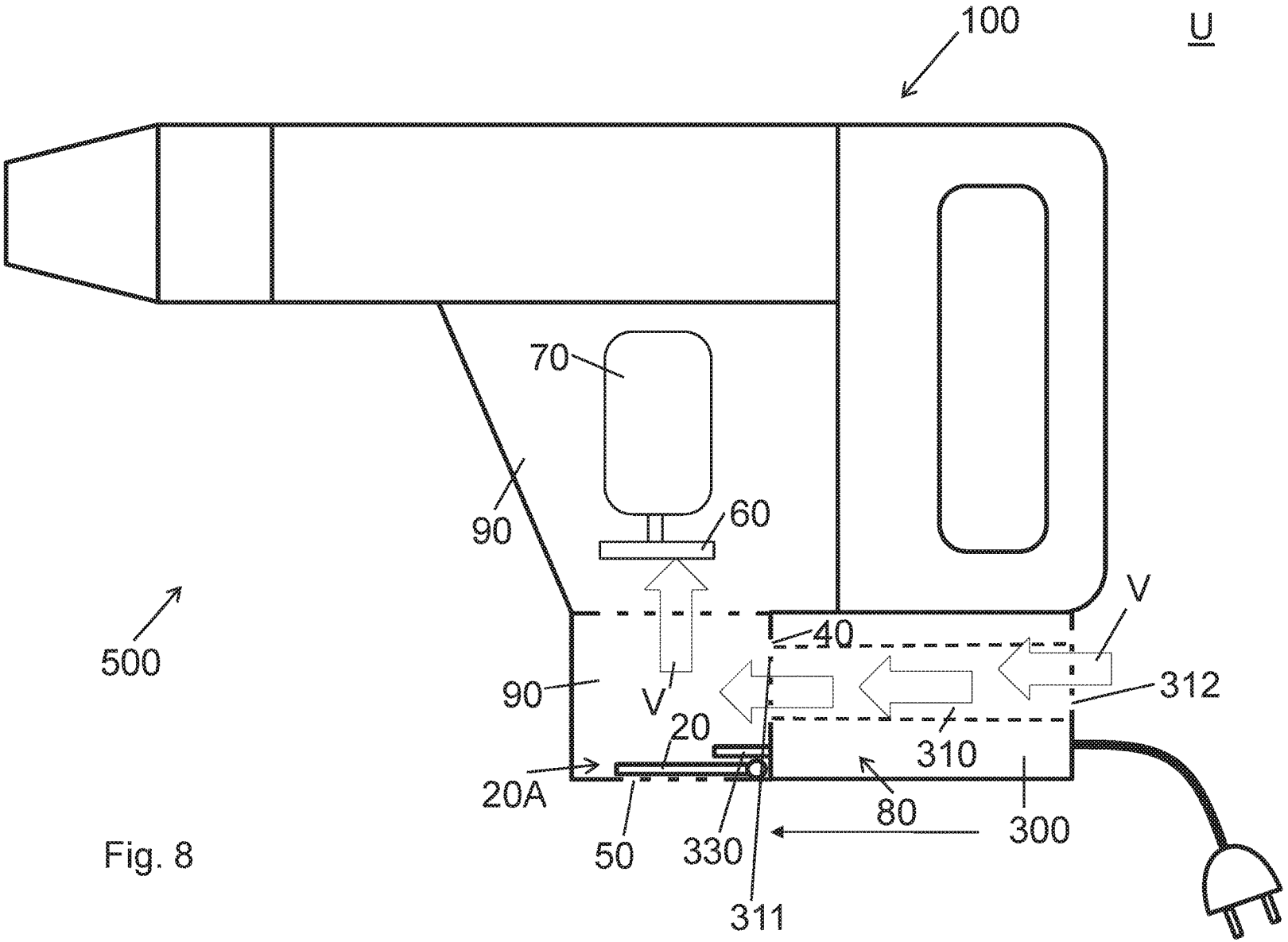
FIG. 8 is another schematic diagram of the tool system from FIG. 6.

In FIG. 8, fanless power supply unit 300 is now completely held in receiving recess 80. The sealing element designed as a sliding element 330 has switched over externally operated change-over gate 20 entirely into a first switch position 20A, so that first vent section 50 is completely sealed and second vent section 40 is completely open. A volume flow V aspirated by cooling fan 60 can now flow through rear vent 312 of power supply unit 300 into inner ventilation channel 310 of fanless power supply unit 300 to cool the latter. Subsequently, volume flow V flows through front vent 311 and second vent section 40 aligned with it into tool housing 90. As long as fanless power supply unit 300 is arranged in receiving recess 80, the sealing element designed as sliding element 330 will retain externally operated change-over gate 20 in first switch position 20A depicted in FIG. 8.

LIST OF REFERENCE SIGNS

V volume flow
U environment
20 change-over gate
20A first switch position
20N second switch position
40 second vent section
50 first vent section
60 cooling fan
70 electric drive motor
80 receiving recess
90 tool housing
100 handheld power tool
200 storage battery
300 power supply unit
310 ventilation channel
311 front vent
312 rear vent
320 sealing plate
330 sliding element
500 tool system

The invention claimed is:

1. A handheld power tool, comprising:

a tool housing, wherein the tool housing has a receiving recess and wherein a storage battery or a power supply unit is replaceably receivable in the receiving recess;

an electric drive motor with a cooling fan;

a first vent section disposed on the tool housing outside of the receiving recess, wherein a volume flow generated by the cooling fan is guidable through the first vent section; and a second vent section that differs from the first vent section, wherein the second vent section is disposed within the receiving recess and wherein the volume flow is at least partially guidable through the second vent section;

wherein a closed-surface storage battery held in the receiving recess seals the second vent section.

2. The handheld power tool according to claim 1, wherein the handheld power tool is a hammer drill or a combination hammer.

3. The handheld power tool according to claim 1, wherein the first vent section and the second vent section belong to different vents.

4. A handheld power tool, comprising:

a tool housing, wherein the tool housing has a receiving recess and wherein a storage battery or a power supply unit is replaceably receivable in the receiving recess;

an electric drive motor with a cooling fan;

a first vent section disposed on the tool housing outside of the receiving recess, wherein a volume flow generated by the cooling fan is guidable through the first vent section;

a second vent section that differs from the first vent section, wherein the second vent section is disposed within the receiving recess and wherein the volume flow is at least partially guidable through the second vent section; and a flow control device, wherein the flow control device distributes the volume flow between the first vent section and the second vent section.

5. The handheld power tool according to claim 4, wherein the flow control device is an externally operated change-over gate which in a first switch position seals the first vent section and which in a second switch position seals the second vent section.

6. A fanless power supply unit for a handheld power tool which has a receiving recess for replaceably holding the fanless power supply unit and an electric drive motor with a cooling fan, comprising:

an inner ventilation channel open to the environment, wherein the fanless power supply unit is force-coolable by a volume flow generated by the cooling fan of the handheld power tool flowing through the inner ventilation channel when the fanless power supply unit is held in the receiving recess of the handheld power tool; and a sealing element, wherein the sealing element at least partially seals a first vent section disposed outside of the receiving recess of the handheld power tool when the fanless power supply unit is held in the receiving recess.

7. The fanless power supply unit according to claim 6, wherein the sealing element is a projecting sealing plate that covers the first vent section.

8. The fanless power supply unit according to claim 6, wherein the sealing element is a slide element, wherein the slide element switches over an externally operated change-over gate provided in the handheld power tool from a second switch position into a first switch position such that a second vent section disposed within the receiving recess of the handheld power tool is opened.

9. A tool system, comprising:

a handheld power tool, wherein the handheld power tool includes:

a tool housing with a receiving recess;

an electric drive motor with a cooling fan;

a first vent section disposed on the tool housing outside of the receiving recess, wherein a volume flow generated by the cooling fan is guidable through the first vent section;

a second vent section that differs from the first vent section, wherein the second vent section is disposed within the receiving recess and wherein the volume flow is at least partially guidable through the second vent section; and a flow control device, wherein the flow control device distributes the volume flow between the first vent section and the second vent section; and a fanless power supply unit receivable within the receiving recess, wherein the fanless power supply unit includes an inner ventilation channel open to the environment and wherein the fanless power supply unit is force-coolable by the volume flow flowing through the inner ventilation channel when the fanless power supply unit is held in the receiving recess.

* * * * *